US006976381B2

(12) United States Patent
Koshizaka et al.

(10) Patent No.: US 6,976,381 B2
(45) Date of Patent: Dec. 20, 2005

(54) FUEL INJECTOR, NOZZLE BODY, AND MANUFACTURING METHOD OF CYLINDRICAL PART EQUIPPED WITH FLUID PASSAGE

(75) Inventors: Atsushi Koshizaka, Hitachinaka (JP); Atsushi Sekine, Hitachinaka (JP); Keiji Kawahara, Hitachinaka (JP); Mizuho Yokoyama, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 8 days.

(21) Appl. No.: 10/100,163

(22) Filed: Mar. 19, 2002

(65) Prior Publication Data

US 2003/0071147 A1 Apr. 17, 2003

(30) Foreign Application Priority Data

Oct. 16, 2001 (JP) ..... 2001-317901

(51) Int. Cl.[7] ..... B21D 22/20
(52) U.S. Cl. ..... 72/341; 72/349
(58) Field of Search ..... 72/341, 347, 348, 72/349, 356, 379.4, 715, 275, 327

(56) References Cited

U.S. PATENT DOCUMENTS 4,599,886 A * 7/1986 Brown ..... 72/349
5,158,236 A 10/1992 Sugiyama et al.
5,239,751 A 8/1993 Kanamaru et al.
5,492,573 A 2/1996 Fukushima et al.
5,944,262 A 8/1999 Akutagawa et al.
6,168,095 B1 1/2001 Seitter et al.

FOREIGN PATENT DOCUMENTS

| | | |
|---|---|---|
| JP | 5-164016 | 6/1993 |
| JP | 6-299933 | 10/1994 |
| JP | 7-214227 | 8/1995 |
| JP | 9-303230 | 11/1997 |
| JP | 10-318079 | 12/1998 |
| WO | WO 99/06692 | 2/1999 |

OTHER PUBLICATIONS

Comments on category "X" documents cited in European Search Report.

* cited by examiner

*Primary Examiner*—Lowell A. Larson
(74) *Attorney, Agent, or Firm*—Crowell & Moring LLP

(57) ABSTRACT

To manufacture a cylindrical member, such as the nozzle body of a fuel injector, in which a fluid passage is formed at high productivity and to improve the reliability.

A cylindrical member, such as the nozzle body of a fuel injector, in which a fluid passage is formed is manufactured by drawing martenstic stainless steel. In addition, during the drawing process of martenstic stainless steel, an intermediate product is annealed and lug is removed after another drawing process, and then is subjected to drawing again to obtain a product.

4 Claims, 8 Drawing Sheets

FUEL INJECTOR, NOZZLE BODY, AND MANUFACTURING METHOD OF CYLINDRICAL PART EQUIPPED WITH FLUID PASSAGE

BACKGROUND OF THE INVENTION

1. Field of the Invention

The present invention relates to a fuel injector (injection valve) and a nozzle body thereof, and also to a method of manufacturing a cylindrical part equipped with a fluid passage, such as a nozzle body.

2. Prior Art

Since the nozzle body of a fuel injector has been required to have corrosion resistance and abrasion resistance, martenstic (martensite) stainless steel has been used as the material meeting the requirement.

A conventional nozzle body made of martenstic stainless steel has been manufactured by cutting or forging.

The Japanese Application Patent Laid-Open Publication No. Hei 5-164016 proposes to manufacture some parts constituting a fuel injector (a case supporting a valve assembly, and a part supporting a coil assembly) by drawing, but nozzle body is not included.

Other cylindrical part than a fuel injector, in which a fluid passage is formed, has never been manufactured by drawing martentic stainless steel.

A method employed for manufacturing a cylindrical part from martenstic stainless steel has been such that the part is cut from a bar or forged from a coil sheet into a rough shape and then finished by grinding. There has been a method of manufacturing a cylindrical part from a steel plate by drawing but, in the case of using martenstic stainless steel, this has never been applied to mass-production.

SUMMARY OF THE INVENTION (Problems to be Solved by the Invention)

If a nozzle body of martenstic stainless steel, used for a fuel injector, is machined by cutting, material yield is lower because it must be cut from a bar. Besides, material hardness is higher because of high C %, cutting resistance is higher because of high shear force of the material, and hence the life of a cutter is short. And besides, productivity is lower because of long machining time. Furthermore, since the inside of the nozzle body functions as a fuel passage, if any bur or chip generated in the cutting process remain inside the nozzle body, it enters into the contact surface of the valve element and causes malfunction and fuel spillage of the valve element, resulting in loss of the product reliability. To prevent this, a nozzle body manufactured by cutting requires a lot of deburring processes after cutting, and also a sufficient cleaning process after deburring. This increases the manufacturing cost.

In case a nozzle body is manufactured by forging, on the other hand, the material yield and productivity improve but the life of metal molds is shorter than when other types of steel are used because the material hardness is higher and accordingly seizure is apt to be caused. Besides, the deformation of the metal molds used for machining is greater because of high machining stress, resulting in low machining accuracy. Furthermore, if any seizure is caused, in the course of the machining, in the fuel passage or on a portion to be engaged with the valve, problems similar to those caused by cutting burs or chips may arise.

In addition, in the case of manufacturing a nozzle body by cutting or forging, its machining involves difficulty if the construction of the nozzle body is as explained below.

That is to say, first, there arises difficulty in a case where the inside diameter of the nozzle body is longer than the internal fluid passage length by two times or more. Since it is difficult to increase the rigidity of the cutter when a nozzle body with this construction is machined by cutting, the machining accuracy lowers remarkably. When the nozzle body is manufactured by forging, on the other hand, the punch for forming the inside diameter of the nozzle body needs to be longer and consequently the bending deformation of the punch increases and the dimensional accuracy lowers remarkably. Forming a hole by several separate shots may be employed as a means of controlling the bending deformation, but this generates a matching area on the inside diameter surface machined by the punch and, since the matching area forms a minor step, dust is apt to be caught there in the course of the machining, and thus problems similar to those caused by cutting burs or chips may arise.

There arises difficulty in another case where one or more steps are formed on the inside diameter of the nozzle body. The shape of the step must be smooth so as not to disturb the fuel flow. Disturbing the flow results in such a problem that the injection flow accuracy and spray profile of the fuel are not stable. To prevent this, the cutting process employs such measures that the material is machined into a rough shape first, and then machined by several separate shots so as to smoothen the shape. As a result, the machining time is long and the manufacturing cost increases.

In the case where the nozzle body is manufactured by forging, on the other hand, it is difficult to form the product by one shot and, as explained above, there arises a problem that a matching area is generated on the inside diameter surface machined by the punch.

Besides, in the case where a valve seat for seating the valve element is formed together with the nozzle body into one piece on the end and machined by cutting, ejection of cutting chips during machining is very poor because the hole to be machined is a pocket, and consequently the life of the cutter is short and the dimensional accuracy lowers. When machined by forging, it is easy to form the two parts into one piece but the machining stress increases extraordinarily as the thickness decreases, and accordingly freedom in designing a product is lost.

In most cases, a nozzle body made of martenstic stainless steel is quenched after machining so as to improve the corrosion resistance and abrasion resistance. In the case of machining by cutting, since dimensions after the machining are not even and the surface roughness is poor, grinding is normally needed after quenching. Because of this, the machining time is long. In addition, grinding equipment is expensive, hence resulting in high equipment cost, and the manufacturing cost increases. In the case of machining by forging, the dimensional accuracy can sometimes be maintained if the dimensions of the metal molds are controlled strictly. However, since the material causes tremendous plastic flow during the machining, deformation due to the thermal stress of quenching is remarkable and the dimensional accuracy is apt to lower. This is particularly remarkable when the axial length inside the nozzle body is longer. For this reason, grinding is necessary after quenching as in the case of machining by cutting.

In the case of other cylindrical part than a fuel injector, in which a fuel passage is formed, there arise similar problems as in the case of the fuel injector Besides, when the fluid is of high pressure or high flow rate, cavitation breakage may be caused. Particularly when a step is formed in the fluid passage, it functions as a throttle and the damage tends to be caused more frequently. The cavitation is caused particularly when the shape of the step is not smooth, resulting in product defect.

The present invention is made in view of the above-mentioned points, and its object is to solve various manufacturing problems resulting from the construction of the nozzle body of a fuel injection valve so as to improve the productivity and decrease the manufacturing cost and to offer high-reliable fuel injector, nozzle body, and cylindrical part equipped with a similar fluid passage.

(Means for Solving the Problems)

(1) To solve the above-mentioned problems, the present invention proposes that the nozzle body of a fuel injector (injection valve) be basically made of martenstic (martensite) stainless steel and formed by drawing.

It is understood that martenstic stainless steel causes less elongation due to plastic deformation, as compared to ordinary steel plates, and accordingly machining by drawing is difficult. For this reason, conventionally, studies have been made more actively on drawing austenite and ferrite stainless steel than on drawing martenstic stainless steel.

The inventors of the present invention, however, have acquired an idea that the afore-mentioned various problems can be solved if the nozzle body of a fuel injector is formed from martenstic stainless steel by drawing, and therefore, have constructed the present invention accordingly.

The present invention further proposes a manufacturing method of a cylindrical part equipped with a fluid passage, such as a nozzle body, which is formed from martensite stainless steel by drawing and yet capable of improving the mass-productivity. Before explaining this manufacturing method, described hereunder are advantages of employing the products manufactured from martenstic stainless steel by drawing.

<1> Because forming a nozzle body by drawing makes it possible to form a pre-finish product into a rough cylindrical shape, the material yield improves and the amount of cutting can lower and consequently less burrs are caused. In addition, since less burrs are caused, defect resulting from burrs can lessen and the product reliability can improve.

<2> Because forming by drawing makes it possible to reduce the machining stress as compared to forming by forging, the dimensional accuracy improves and, even if cutting is employed in the post-process, the amount of cutting can lower. In the case of forming by forging, seizure is caused on the inside diameter side where the valve element is installed because the punch pressure is applied onto the inside diameter side. In the case of forming by drawing, however, seizure is apt to be caused on the outside diameter side because the metal mold pressure is applied onto the outside diameter side. As explained above, seizure on the inside diameter may injure the product reliability as it obstructs the valve element movement. Since forming by drawing solves this problem, the reliability can improve.

(2) The present invention further proposes a nozzle body formed by drawing martenstic stainless steel, of which fuel passage length is longer than the inside diameter of the nozzle body by two times or more.

With the above construction, conventional problems caused in machining by cutting can be eliminated even for a nozzle body equipped with a slender fuel passage. In other words, since increasing the rigidity of the cutter is difficult in the case of machining by cutting, the slender construction of a nozzle body results in a problem of low machining accuracy. Since this problem is not caused in the case of machining by drawing, on the other hand, the machining accuracy can improve remarkably. In the case of machining by drawing, as compared to machining by forging, even if the fluid passage length is made longer than the inside diameter of the nozzle body by two times or more, any step caused in forging is not caused, and hence smooth surface can be formed. As a result, a problem of dust accumulation is eliminated.

(3) A nozzle body formed by drawing martenstic stainless steel is suitable for the body construction in which one or more steps are formed. In the case of machining by drawing, a step is formed by several shots but, as explained above, the pressure is applied onto the outside diameter side. That is, since the machining stress generated on the inside diameter side is small, the shape of the step formed on the inside diameter side by the pressure is smooth and no matching area as generated in the case of machining by forging is seen. As a result, the defect explained above can be eliminated.

(4) A nozzle body formed by drawing martenstic stainless steel is suitable also for the body construction in which a valve seat for seating the valve element is formed together with the nozzle body into one piece on the end.

That is to say, a greater effect is expected in the case of machining the nozzle body by drawing because the body is made into a cylindrical bottomed shape. The material deformation is the least particularly at the bottom and the dimensional accuracy is stable. In the case of machining a bottomed shape by cutting, poor ejection of cutting chips during machining is a problem, and consequently the life of the cutter is short, which in turn results in cost increase. A process that the valve seat is formed at the bottom involves another problem. The seat, which is provided for sealing the fuel, affects the reliability of the fuel injector seriously. High-accuracy machining is required, and the required accuracy (in particular, circularity) is 1 $\mu$m or less. Generally, a cylindrical member is formed for the nozzle body, and then the seat is machined. It is manufactured through the processes where a rough shape of the seat is formed by cutting on the bottom of the cylindrical member, formed into a specified shape, and then the member is quenched and machined by grinding. The required accuracy is accomplished through the grinding but, if the machining accuracy in the cutting process is poor, there arises a problem that the accuracy after grinding is also poor. This is because grinding requires longer machining time than cutting and accordingly the amount of grinding must be as little as possible to shorten the machining time. This is also because the grinding force is smaller than the cutting force and accordingly, if the cutting accuracy is poor, i.e. the surface irregularity of the material is excessive, for example, it can be ground in no other way but into a shape along the irregularity.

On the other hand, the bottom can be formed also by forging but, because plastic flow is caused, hardening has resulted from the machining. As a result, the cutting resistance is high, the cutting accuracy lowers, and the problem above is caused.

(5) Besides, for a nozzle body formed by drawing martensite stainless steel, it is possible to allow the inside diameter of the nozzle body to have the surface machined by drawing. The dimensions of a product formed by drawing depend upon the dimension setting of the metal mold for forming the inside diameter (male mold) and metal mold for forming the outside diameter (female mold), and so required dimensional accuracy is easily accomplished by controlling the metal mold dimensions. And besides, because the plastic flow is less and machining stress is smaller than in the case of forging, the deformation of the metal mold (in particular, bending deformation) is smaller and accordingly the dimensional accuracy can improve. When a quenching process is employed, the deformation lessens remarkably as compared to that in the machining by forging.

(6) Forming the nozzle body by drawing martenstic stainless steel with carbon content of 0.3 to 0.4 weight % and plate thickness of 0.5 to 2.0 mm results in an excellent product.

(7) Not only for a nozzle body but also for a similar cylindrical part in which a fuel passage is formed, the present invention proposes to form the product by drawing martenstic stainless steel. Similar effects are produced also in other cylindrical part as above than a fuel injector. In addition, because a throttling step can be formed smooth, occurrence of the cavitation can be eliminated and the product reliability can improve.

(8) The present invention also proposes the following manufacturing method so as to form a cylindrical part equipped with a fluid passage, such as a nozzle, by drawing martenstic stainless steel.

Previously, in drawing martensite stainless steel, it was necessary to improve the following points.

That is, because the material elongation is small, the product ruptures in the drawing process or cracks are caused on the surface. Besides, in the drawing process, since rolled steel has anisotropy along its rolling direction, a portion, so-called lug is formed at the open end (skirt) of the shape to be produced by drawing. Though several shots of drawing are necessary to accomplish specified product dimensions, residual compression stress increases and greater lug is formed at the open end (skirt) of the product to be formed by drawing as a result of several shots. When the product is removed from the molds, the increased residual compression stress is released momentarily, which in turn may result in vertical crack at a point of stress concentration due to the shape of the lug. For the above reasons, drawing martensite stainless steel has been regarded difficult.

For forming a cylindrical part from martenstic stainless steel according to the present invention, the first thing to be noted is to employ rolled steel. Rolled steel with favorable flatness and surface roughness is available at low cost. Material with poor surface roughness is apt to cause cracks during drawing. To prevent this, dull-finished and bright-finished steel is desirous.

Several shots of drawing are needed to obtain specified product shape. Since the material elongation of martenstic stainless steel is less than 30%, cracks are caused on the surface if the drawing ratio (blank diameter/contraction diameter) exceeds 2.5. At this level of drawing ratio, no crack is caused in the case of cold rolled steel plate (SPCC), austenite stainless steel plate, and ferrite stainless steel plate. Particularly in the case of austenite stainless steel and ferrite stainless steel, a lot of steel plates with improved drawability have been developed and used in practice. As a means of preventing cracks on the surface, according to the present invention, an intermediate product formed by drawing is annealed one or more times at the drawing ratio of 2.5 or less so as to eliminate the machining distortion, and then formed by drawing again so as to be able to complete a cylindrical member in excess of the drawing ratio of 2.5. Considering the efficiency of the drawing process using a press, number of times of annealing is desired to be as little as possible. Accordingly, the least possible times of annealing shall be applied and efficient annealing is realized at the drawing ratio of 1.9 to 3.7.

If annealing is carried out after every drawing process, a cylindrical part (cylindrical member) of greater drawing ratio can be formed without causing any crack but the productivity lowers. When an intermediate product, having been annealed one or more times at the drawing ratio of 2.5 or less, is subjected to drawing after annealing and the drawing ratio exceeds 3.7, vertical cracks are caused, originating from the lug at the open end. This is because the plate thickness increases and consequently the compression stress becomes dominant at the open end (skirt) of the shape to be produced by drawing. The compression stress increases as the drawing process is repeated and a lug is formed at the open end due to the anisotropy accompanied by rolled steel, and consequently stress concentration is caused due to the shape of the lug. Though applying an annealing process eliminates the residual stress due to drawing and hence is effective to solve this problem as well, there arises a problem of low productivity. For this reason, according to the present invention, lug is removed at the drawing ratio of 3.7 or less so as to eliminate the origin of the stress concentration.

Carrying out a drawing process after the above, it becomes possible to manufacture a cylindrical member in excess of the drawing ratio of 3.7 or more. Since lug is formed through every drawing process, it may be ideal to remove the lug after every process, but the productivity lowers. The lug shall be removed preferably the least possible times and efficient lug removal is realized at the drawing ratio of 3.2 to 3.7. Lug removal can be performed not only through annealing but using a press or metal mold. A possible method includes shimmy trimming and pinch trimming. As a result that the productivity is maintained as above, it becomes possible to draw martensite stainless steel.

Though a cylindrical member (such as nozzle body) of martenstic stainless steel is manufactures in a sequence of drawing—annealing—drawing—lug removal according to the manufacturing method explained above, a sequence of drawing—annealing—lug removal—drawing or a sequence of drawing—lug removal—annealing—drawing is also possible.

DETAILED DESCRIPTION OF THE INVENTION (Description of the Preferred Embodiments)

Preferred embodiments of the present invention are explained hereunder, using the drawings.

Figure 1:
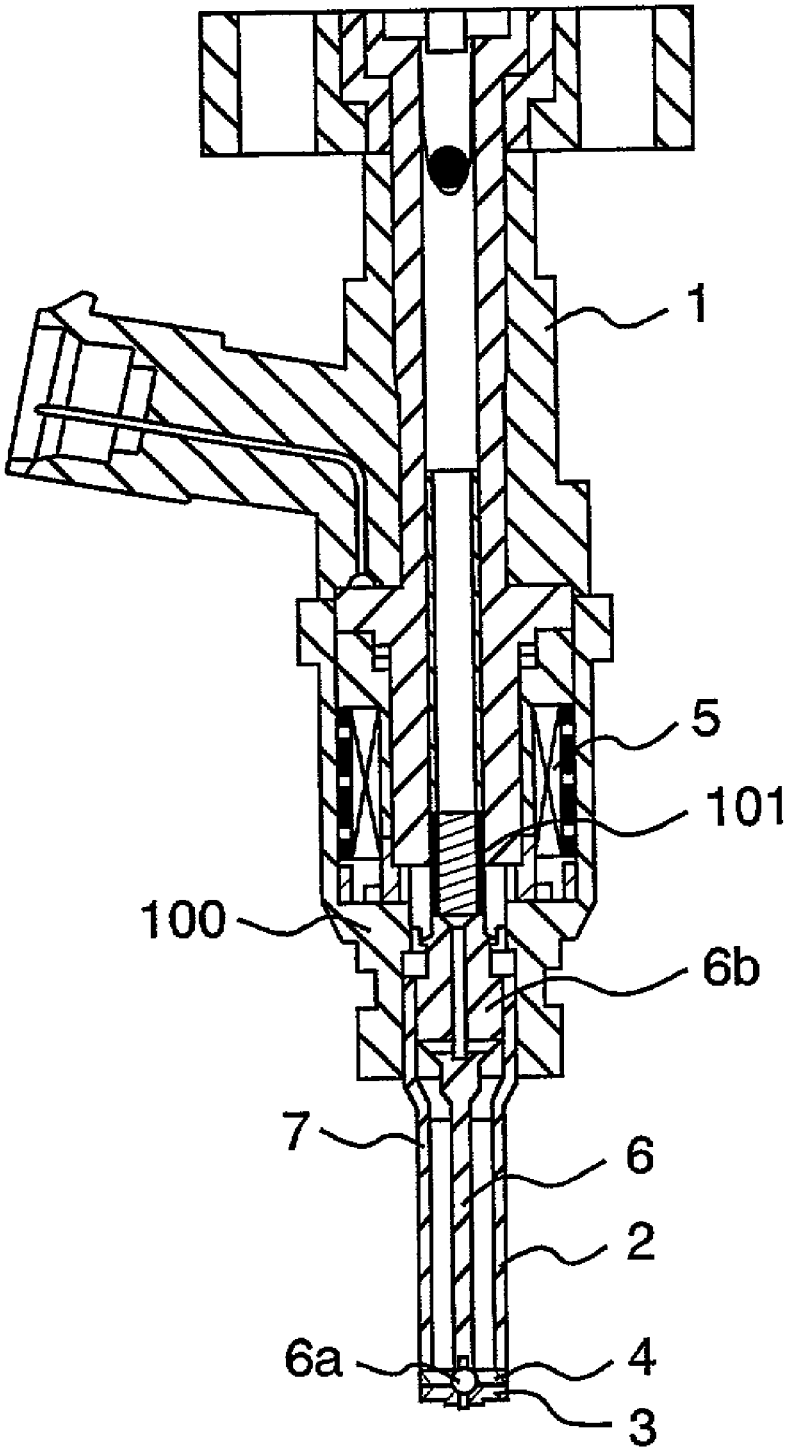
FIG. 1 is longitudinal section of a fuel injector according to an embodiment of the present invention.

FIG. 1 is a longitudinal section of a fuel injector valve equipped with a nozzle body formed by drawing. The fuel injector 1 has an electromagnetic coil 5 and return spring 101, built in a housing 100, for driving a valve element 6. A housing 101 functions as part of a magnetic circuit when the electromagnetic coil 5 is excited. The nozzle body 2 formed by drawing is installed on the end of the housing 101. An orifice plate 3 for injecting fuel and a swirler 4 for providing the fuel with a swirling force are connected to the end of the nozzle body 2.

Figure 2:
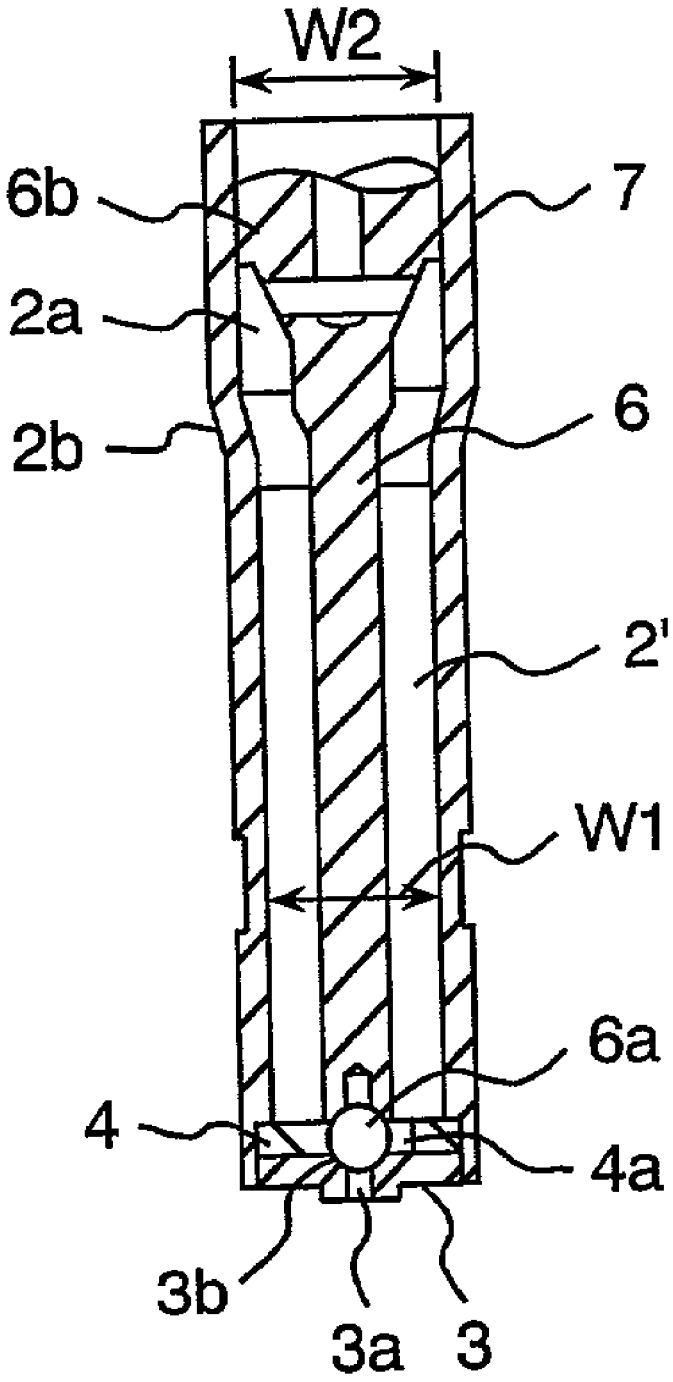
FIG. 2 is enlarged view of a valve assembly used for the above embodiment.

The valve element 6, which can be reciprocated along the axial direction as the electromagnetic coil 5 is energized, is built in the nozzle body 2. FIG. 2 is an enlarged view of a valve assembly 7 comprising the nozzle body 2, orifice plate 3, swirler 4, and valve element 6.

The orifice plate 3 comprises an orifice 3*a* and seat 3*b* for serving to meter the fuel flow. When the valve element 6 is shut, a ball 6*a* mounted on the end of the valve element 6 is seated on the seat 3*b* by the return spring force and seals the fuel.

The swirler 4 provides the fuel with a swirling force and serves to guide the ball 6*a* mounted on the valve element 6. The fuel provided with a swirling force by the swirler 4 passes through the seat 3*b* and orifice 3*a*, and then is sprayed. The fuel provided with a swirling force by the swirler 4 is atomized so as to enhance the performance of the fuel injector.

The valve element 6 can be reciprocated as the ball 6*a* mounted on its end is guided along the inside diameter 4*a* of the swirler 4 and the valve guide 6*b* (moving core) located opposite to the ball 6*a* is guided along the inside diameter 2*a* of the nozzle body 2.

The nozzle body 2 is formed into a slender sleeve shape by drawing martenstic (martensite) stainless steel. The inside periphery of nozzle body 2 functions as a fuel passage 2' and the valve element 6 is built in the nozzle body 2 so as to be able to reciprocate. The nozzle body 2 is so formed, through several shots of drawing, that the inside diameter W1 of one portion from the end to a mid point and the inside diameter W2 of the other portion from the mid point to the other end are set W1<W2 and connected with a tapered step. The moving core 6*a*, which is formed together with the valve element 6 into one piece, is so installed as to be guided along the inside periphery of the end 2*a* of the nozzle body 2. The moving core 6*a*, together with the housing 101, functions as part of the magnetic circuit upon the excitation of the electromagnetic coil 5. The length of the internal fuel passage 2' is longer than the inside diameter of the nozzle body by two times or more.

In order to maintain the fuel flow accuracy, which is one of the major performances of the fuel injector 1, smooth reciprocating movement of the valve element 6 is mandatory. To realize smooth reciprocating movement, it is necessary to optimize the gap distance between the ball 6*a* and the inside diameter 4*a* of the swirler 4 and the gap distance between the moving core (valve guide) 6*b* and the inside diameter of the end 2*a* of the nozzle body 2. For this purpose, it is necessary to maintain the dimensional accuracy of individual part itself. For example, the gap distance is set to approximately 10 to 50 $\mu$m and the dimensions of individual part must be as accurate as this distance can be achieved when the parts are put together. In addition, the guides need to be installed coaxially because, if not installed in linear, bend is caused on the valve element 6 and obstructs the reciprocating movement. The fuel is passed through the gap between the nozzle body 2 and the valve element 6 and then injected, but, if there is any bur or dust in the course, the bur or dust is carried into the seat 3*a* by the fuel flow and caught between the ball 6*a* and the seat 3*a*, which in turn may result in a defect, leakage from the seat. Leakage from the seat may lead to a defect such as damage to an engine. For this reason, in the manufacturing process of the nozzle body 2, particularly the inside diameter side is strictly controlled to be free of bur and dust. In addition, since the fuel injector 1 is employed as a fuel injector for a chamber injection system, the valve element is characteristic in it that the nozzle body 2 is longer than a conventional type fuel injector.

The dimension of the guide of the valve element 6 needs preferably to be greater so as to improve the accuracy of the reciprocating movement of the valve element 6 and, for this purpose, the nozzle body is made slender as a whole but the inside diameter of the end portion is made larger by means of a stepped shape. This shape is proposed in order to accomplish sufficient freedom in mounting the valve (injector) on the cylinder head of an engine. If the nozzle body 2 with slender and stepped shape like the above is manufactured by conventional cutting or forging process, the manufacturing cost increases and, since controlling to eliminate bur and dust is difficult, the product reliability lowers. When it is manufactured by drawing, the surface of the inside periphery 2*b*, which forms the fuel passage of the nozzle body 2, can be made smooth and the problems above can be eliminated.

Next, the manufacturing method of a nozzle body 2 is explained hereunder.

Figure 3:
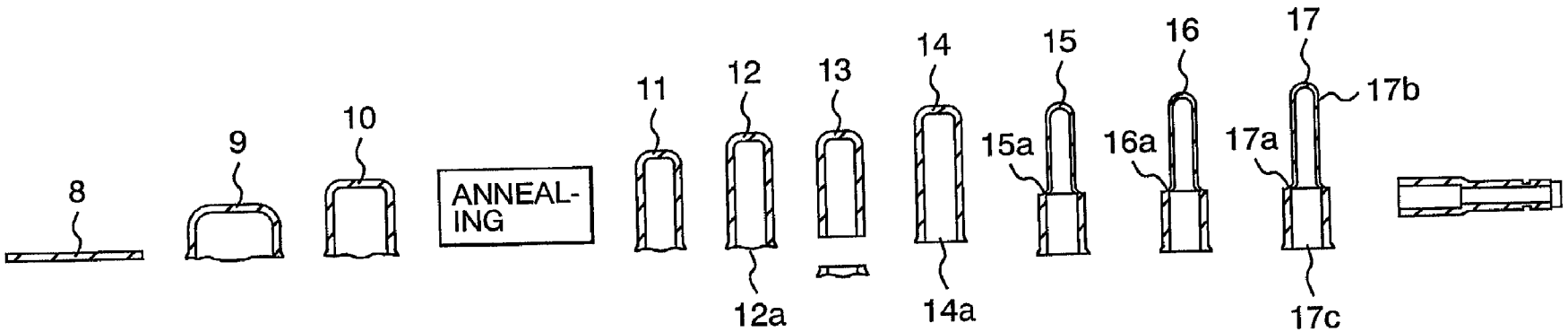
FIG. 3 is rough manufacturing process of a nozzle body used for the above embodiment.

FIG. 3 shows rough manufacturing process. It is made of martenstic stainless steel with plate thickness of 1.0 mm. This material is rolled steel and the surface is bright-finished. To start with, a blank 8 is formed from the material. Generally, forming a blank by stamping is desirous as it realizes high productivity. The outside diameter of the blank 8 is 32 mm.

Next, an intermediate product A 9 is manufactured, using a drawing metal mold. Then, an intermediate product B 10 is formed. The inside diameter is 13.2 mm. The contraction ratio (blank diameter/contraction diameter) is 2.4 in this drawing.

Next, the product is subjected to an annealing process. In this embodiment, annealing is done at 740° C. If annealing is not carried out at this point of manufacturing but an intermediate product C 11 is formed, cracks are caused on the surface. This is because the product elongation reaches the limit. When a drawing process is carried out after an annealing process, the intermediate C 11 can be formed without problem.

Next, an intermediate product D 12 is formed. The inside diameter is 9 mm and the drawing ratio (blank diameter/drawing diameter) is 3.6 in this drawing. Next a lug 12*a* is removed and an intermediate product E 13 is formed. Lug can be removed either by means of metal mold or by cutting, but removal by means of metal mold is desirous so as to avoid productivity loss. In this embodiment, lug is removed by pinch trimming in a metal mold. If the lug removal process is omitted and an intermediate product E is formed, vertical cracks are caused at the end 14*a* at the time when the product is removed from the metal mold.

After the lug removal process, the intermediate product F 14 can be manufactured without any problem. This is because the compression stress acts upon the end 14*a* as a result of the drawing process and, when the product is removed from the metal mold after drawing, the stress is released momentarily and concentrated due to the shape of the lug, resulting in vertical cracks.

Figure 4:
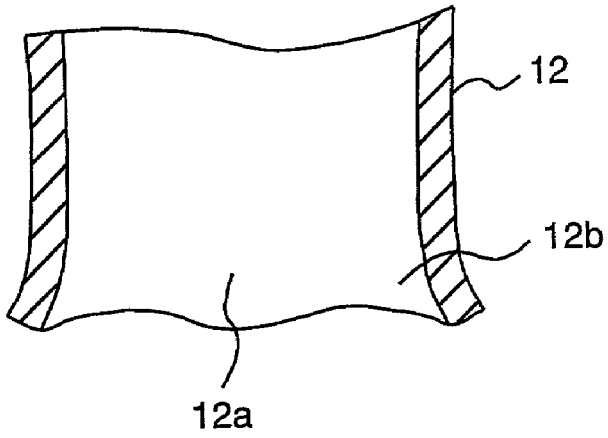
FIG. 4 is enlarged view of a condition where lug is formed on the intermediate member of the nozzle body in the process in FIG. 3.
Figure 5:
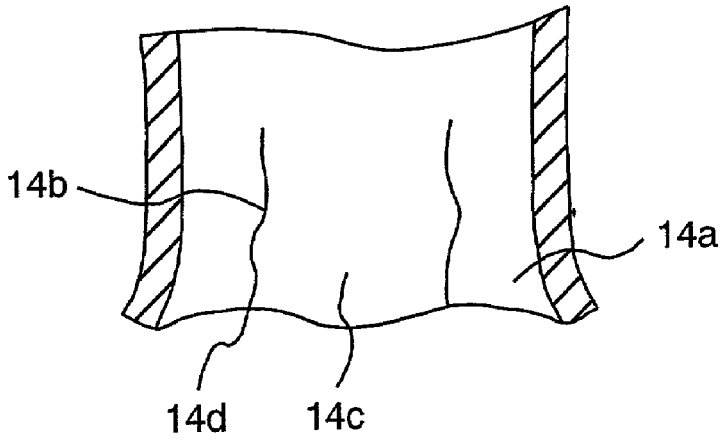
FIG. 5 is enlarged view of a condition where vertical scratches are caused on the intermediate member of the nozzle body in the process in FIG. 3.

FIG. 4 is an enlarged view of a typical lug formed on the intermediate product D 12. The lug 12*a* results from the anisotropy caused in the rolling process of the material, and it is hard to control in view of the manufacturing method. Four lugs 12*a* are formed on the end 12*b*. FIG. 5 is an enlarged view of vertical cracks that are caused as a result of drawing without carrying out a lug removal process. The vertical crack 14*b* is caused, originating from a trough 14*d* of the lug 14*c*. There are four troughs 14*d* at the end 14*a*, but the crack is not always caused at every trough. Carrying out a lug removal process makes it possible to eliminate the origin of stress concentration, and hence to prevent vertical crack. In addition, ironing the end 14*a* and its adjacent in the forming process of the intermediate product F 14, the inside diameter accuracy can drastically improve.

In this embodiment, the variation of the inside diameter accuracy can be limited within 10 μm or less. Next, an intermediate product G 15 is formed. In the processes after this, the step at the top is formed. Next, an intermediate product H 16 is formed. Then, an intermediate product I 17 is formed. In the intermediate product I 17, the nozzle body is formed into a rough shape and drawing is complete here. In forming the step 15*a*, 16*a*, and 17*a* in the drawing process, since no restriction applies to the metal mold of the inside diameter side but the shape to be formed is determined solely by the shape of the metal mold for the outside diameter side, a smooth shape can be formed. Part of the intermediate product I 17 formed by drawing is cut off in order to obtain the final shape of the nozzle body 2. Because the accuracy and surface condition of the inside diameter is excellent, the final shape of the nozzle body 2 is obtained simply through a cutting process of the bottom 17*b* and end 17*c*. If the valve seat 2*c* is formed together into one piece, the bottom 17*b* needs not be cut off.

Figure 6:
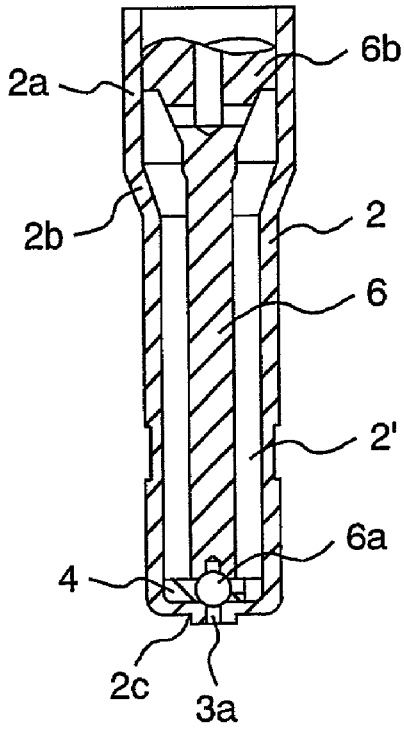
FIG. 6 is longitudinal section of a valve assembly according to the second embodiment of the present invention.
Figure 7:
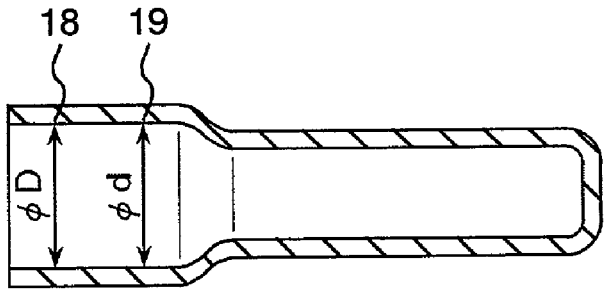
FIG. 7 is longitudinal section of a nozzle body manufactured in the process in FIG. 3.

FIG. 6 is an enlarged view of a valve assembly in which the valve seat 2*c* is formed together into one piece. After this process, the nozzle body 2 is quenched, part or whole, and then put into a product.

According to this embodiment, the nozzle body 2, which is formed by drawing though, plastic flow can be made more even, as compared to one formed by forging, and, since an annealing process is carried out in the course of manufacturing, residual stress can be made less, resulting in less deformation due to quenching. According to the result of an experiment by the inventor, the deformation is about 10 μm in the inside diameter and no remarkable variation from a specimen to another is found. In order to obtain the nozzle body 2 with much higher accuracy, however, par of the product, such as the inside diameter, is sometimes machined by grinding after the quenching process. When this happens in the case of a product formed by drawing, the inside diameter at the end 18 is ϕD but that at a deeper location 19 is ϕd, that is, a little greater (by 10 to 40 μm). Since this means that the shape of the location is recessed from the edge of the grindstone in a grinding process, it is advantageous for the life of the grindstone. This phenomenon is caused because the plate thickness of the end 18 has become thicker than other portions as a result of drawing.

Figure 8:
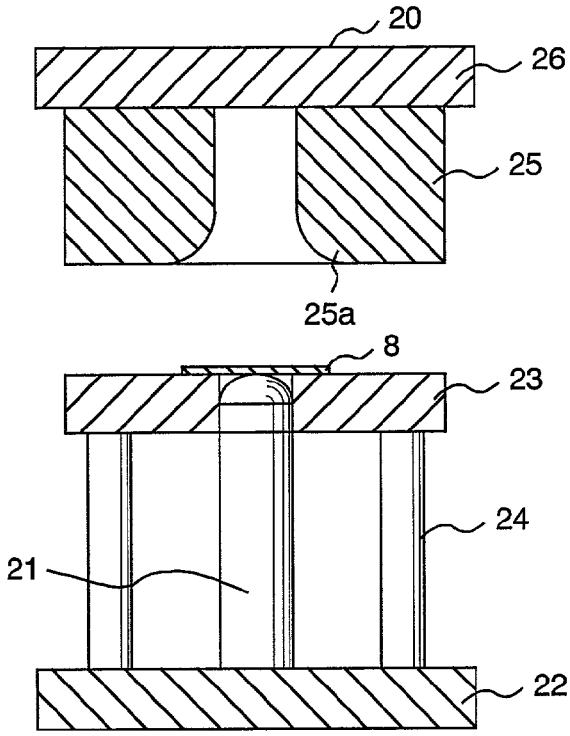
FIG. 8 is longitudinal section of a drawing metal mold used for manufacturing a nozzle body of the embodiment.

FIG. 8 through FIG. 13 show the metal molds employed for the drawing processes. FIG. 8 is a metal mold 20 for forming the intermediate product A 9.

The male mold 21 for forming the inside diameter of the nozzle body 2 is fixed on a lower plate 22. In the drawing process, a blank holder pad (a wrinkle suppressor) 23 for suppressing wrinkle on the blank 8 is set on a cushion pin 24 built in a press. The cushion pin 24 transmits the pressure of a cushion cylinder.

Figure 9:
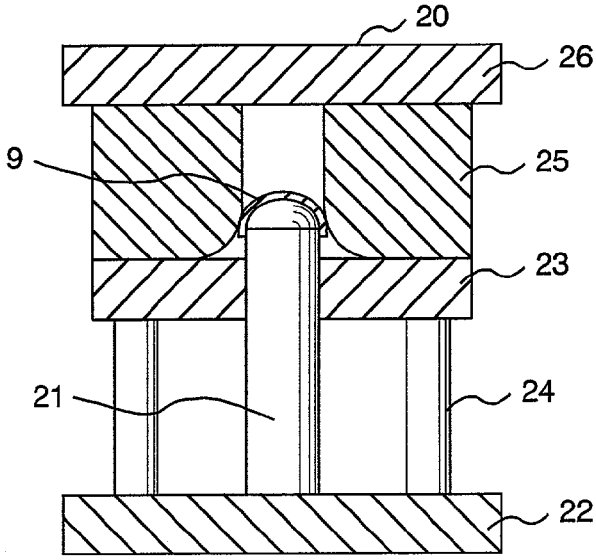
FIG. 9 is longitudinal section of a product being processed on the metal mold in FIG. 8.

The female mold 25 for forming the outside diameter of the nozzle body 2 is fixed on an upper plate 26, and a rounded portion 25*a*, which is important to load the stress onto the material during forming, is formed on the open end of the female mold 25. FIG. 9 shows a condition where the intermediate A is formed on the metal mold 20.

Figure 10:
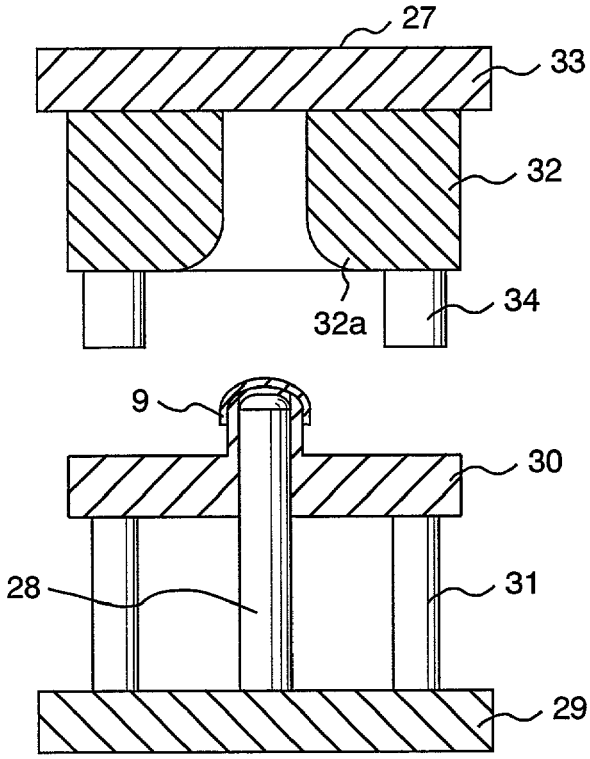
FIG. 10 is longitudinal section of a drawing metal mold used for manufacturing a nozzle body of the embodiment.

The blank 8, sandwiched between the wrinkle suppressor 23 and the female mold 25, is given a suitable wrinkle suppressing force, and is formed into a cylinder through the gap between the male mold 21 and the female mold 25. FIG. 10 shows a metal mold 27 for drawing the intermediate product A 9, formed into a cylinder, again into the intermediate product B 10.

Figure 11:
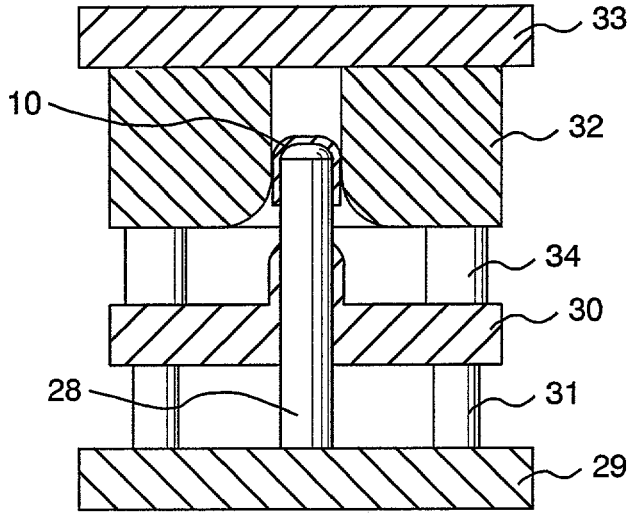
FIG. 11 is longitudinal section of a product being processed on the metal mold in FIG. 10.

The male mold for forming the inside diameter is fixed on a lower plate 29. In the drawing process, a wrinkle suppressor 30 for suppressing wrinkle on the intermediate product A 9 is set on a cushion pin 31, built in a press, for transmitting the pressure of a cushion cylinder. The female mold 32 for forming the outside diameter is fixed on an upper plate 33, and a rounded portion 32*a*, which is important to load the stress onto the material during forming, is formed on the open end of the female mold 32. A pushing pin 34 is set on the female mold 32 so that the cushion force is transmitted in good timing. FIG. 11 shows a condition where the intermediate product B 10 is formed on the metal mold 27. The intermediate product A 9, sandwiched between the wrinkle suppressor 30 and the female mold 32, is given a suitable wrinkle suppressing force, and is formed into a cylinder through the gap between the male mold 28 and the female mold 32. Using the metal molds having similar constructions as explained above, the intermediate product C 11, intermediate product D 12, and intermediate product F 14 are formed after this step.

Figure 12:
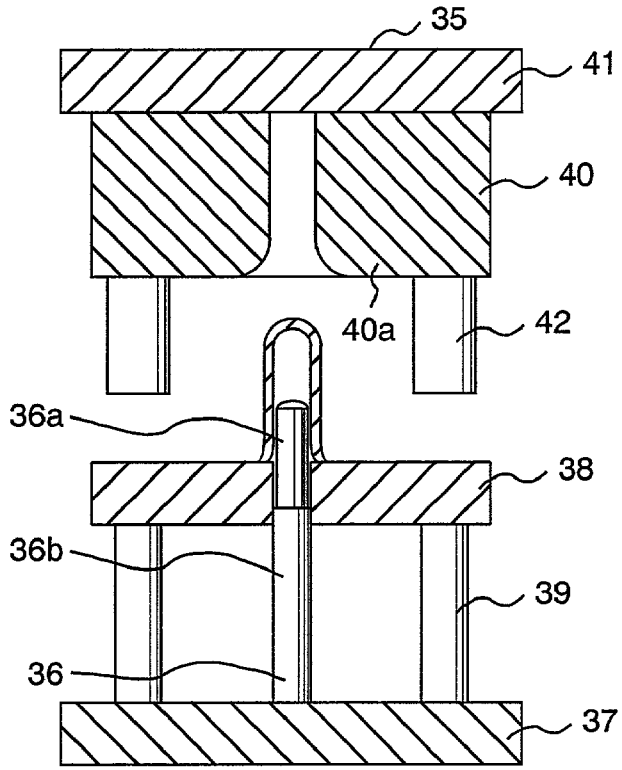
FIG. 12 is longitudinal section of a drawing metal mold.

FIG. 12 shows a metal mold 35 that forms a step in the intermediate product F 14 formed into a cylinder. The male mold 36 for forming the inside diameter is fixed on a lower plate 37. A knockout plate 38 for ejecting the intermediate product G 15 after the process is set on a cushion pin 39, built in a press, for transmitting the pressure of a cushion cylinder. The female mold 40 for forming the outside diameter is fixed on an upper plate 41 and a rounded portion 40*a*, which is important to load the stress onto the material during forming, is formed on the open end of the female mold 40. Although wrinkle suppression in not necessary in this process, a pushing pin 41 is set on the female mold 40 so that the cushion force (knockout force) is transmitted in good timing. It is preferred that the male mold 36 is constructed to have a stepped shape 36*b* having the dimension corresponding to the inside diameter for forming the top 36*z* and the dimension matching with the inside diameter of the intermediate product F 14. Constructing the stepped shape 36*b* in a dimension nearly equal to the inside diameter of the intermediate product F 14 allows to eliminate idle movement during the process and to improve the coaxiality after the process.

Figure 13:
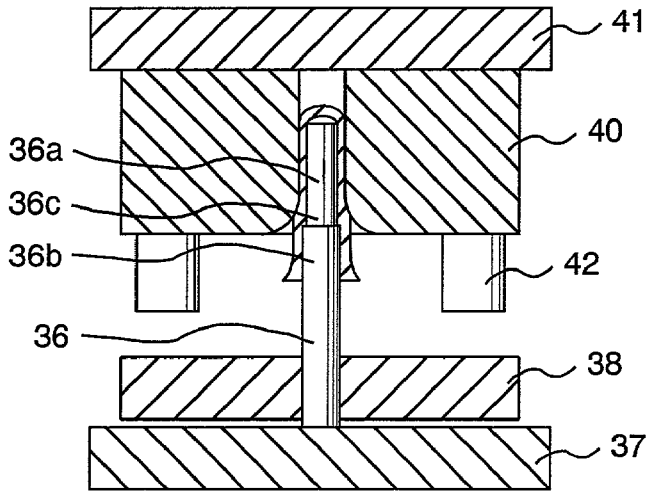
FIG. 13 is longitudinal section of a product being processed on the metal mold in FIG. 12.

FIG. 13 shows a condition where the intermediate product G 15 is formed on a metal mold 35. The intermediate product F 14, sandwiched between the wrinkle suppressor 38 and the female mold 40, is given a suitable wrinkle suppressing force, and is formed into a stepped cylinder through the gap between the male mold 36 and the female mold 40. In this process, the stress is transmitted to the material by the rounded portion 40*a* of the female mold 40, and contact with the step 36*c* of the male mold 36 is not necessary for forming the step 15*a*. As a result, the shape of the inside diameter becomes smooth.

Using the metal molds having similar constructions as explained above, the intermediate product H 16 and intermediate product I 17 are formed after this step.

For a nozzle body in this embodiment, excellent product is obtained by drawing martenstic stainless steel with carbon content of 0.3 to 0.4 weight % and plate thickness of 0.5 to 2.0 mm.

According to the preferred embodiments as explained above, a low-cost and high-reliable cylindrical member of martenstic stainless steel can be manufactured, and hence a low-cost and high-reliable fuel injection valve can be realized.

Besides, using a cylindrical member according to the present invention for a fluid passage, it is possible to offer a fluid passage that does not cause any cavitation even at high pressure and high flow rate.

(Effects of the Invention)

According to the present invention, it is possible to realize a high-reliable fuel injection valve, which is made free of bur and dust and in which a smooth fuel passage is formed, and a cylindrical member, such as a nozzle body, which forms a fluid passage that eliminates the occurrence of cavitation, and to manufacture the above at lower cost and high productivity.

What is claimed is:

1. A method of manufacturing a cylindrical part by drawing a material which is martensitic stainless steel made by rolling, wherein specified dimensions of the cylindrical part are accomplished through the following processes:

manufacturing a cylindrical intermediate product by drawing the material, annealing the intermediate product at least one time, drawing the annealed intermediate product, removing a lug which is due to anisotropy of the material, and subsequently further drawing the intermediate product to form the cylindrical part as a finished product.

2. A method of manufacturing a cylindrical part by drawing a material which is martensitic stainless steel made by rolling, comprising:

manufacturing a cylindrical intermediate product by drawing the material, annealing the intermediate product one or more times, drawing the annealed intermediate product, removing a lug which is formed at the opening of the intermediate product due to anisotropy of the material, and subsequently further drawing the intermediate product to form the cylindrical part as a finished product.

3. A method of forming a cylindrical part by drawing a material which is martenstic stainless steel made by rolling, wherein specified dimensions of the cylindrical part are accomplished through the following processes:

manufacturing a cylindrical intermediate product by drawing the material at least one time, annealing said intermediate product one or more times at a blank diameter/drawing diameter drawing ratio of 2.5 or less, drawing the annealed intermediate product at least one time, removing a lug, which forms at an opening of said intermediate product due to anisotropy of the material, at a drawing ration of 3.7 or less, and subsequently further drawing the intermediate product at least one time to form the cylindrical part as a finished product.

4. A method of manufacturing a cylindrical part by drawing a material which is martensitic stainless steel made by rolling, wherein specified dimensions of the cylindrical part are accomplished through the following processes:

manufacturing a cylindrical intermediate product by drawing the material at least one time, annealing said intermediate product one or more times at a blank diameter/drawing diameter drawing ratio of 1.9 to 2.5, drawing the annealed intermediate product one or more times, removing a lug, which is formed an opening of the intermediate product due to anisotropy of the material, at a drawing ratio of 3.2 to 3.7, and subsequently further drawing the intermediate product at least one time to form the cylindrical part as a finished product.

* * * * *